US005613561A

United States Patent [19]

Moriarty

[11] Patent Number: 5,613,561

[45] Date of Patent: Mar. 25, 1997

[54] APPARATUS FOR SEALING INSTRUMENTS IN A DOWNHOLE TOOL

[75] Inventor: Keith A. Moriarty, Houston, Tex.

[73] Assignee: Schlumberger Technology Corporation, Sugar Land, Tex.

[21] Appl. No.: 508,015

[22] Filed: Jul. 27, 1995

[51] Int. Cl.[6] ..... E21B 33/12

[52] U.S. Cl. ..... 166/387

[58] Field of Search ..... 166/381, 386, 166/387; 175/40, 45, 48–50, 92, 243

[56] References Cited

U.S. PATENT DOCUMENTS

| | | | |
|---|---|---|---|
| 3,777,814 | 12/1973 | Gustavson et al. | 166/287 X |
| 3,858,649 | 1/1975 | Wray et al. | 166/162 |
| 3,860,069 | 1/1975 | Wray et al. | 166/264 |
| 3,901,314 | 8/1975 | Nutter | 166/152 |
| 3,927,553 | 12/1975 | Frantz | 73/4 R |
| 3,964,305 | 6/1976 | Wray et al. | 166/224 A |
| 3,991,975 | 11/1976 | Sibrava | 251/317 |
| 4,051,897 | 10/1977 | Kingelin | 166/133 X |
| 4,230,180 | 10/1980 | Patton et al. | 166/185 |
| 4,281,724 | 8/1981 | Garrett | 175/195 |
| 4,443,206 | 4/1984 | Teng | 175/322 |
| 4,457,489 | 7/1984 | Gilmore | 166/344 |
| 4,553,428 | 11/1985 | Upchurch | 175/48 X |
| 4,600,062 | 7/1986 | Teng | 175/322 |
| 4,896,689 | 1/1990 | Taylor | 137/70 |
| 4,901,761 | 2/1990 | Taylor | 175/48 X |
| 4,986,361 | 1/1991 | Mueller et al. | 166/381 |
| 5,022,473 | 6/1991 | Taylor | 175/299 |
| 5,117,915 | 6/1992 | Mueller et al. | 166/381 |
| 5,134,285 | 7/1992 | Perry et al. | 250/269 |
| 5,181,571 | 1/1993 | Mueller et al. | 166/381 |
| 5,228,519 | 7/1993 | Coronado et al. | 166/387 |
| 5,337,598 | 8/1994 | Rab | 73/49.8 |
| 5,379,839 | 1/1995 | Hisaw | 166/250.07 |
| 5,473,939 | 12/1995 | Leder et al. | 166/264 X |

*Primary Examiner*—Roger J. Schoeppel

*Attorney, Agent, or Firm*—Anthony V. S. England; Wayne I. Kanak

[57] ABSTRACT

An apparatus for sealing a first pressure environment from a second, lower pressure environment, includes a plug having a desired cross section for insertion into a barrier wall aperture shaped to receive the plug. The barrier wall has a first pressure environment on its outside surface and a second environment on its inside surface. A bearing surface on the plug bears against the wall of the aperture. A flexing member, subject to and reactive to the first pressure environment, has an outer surface providing at least a portion of the bearing surface. The flexing member, in reacting to the first pressure environment, flexes at least a portion of the bearing surface to bear more tightly against the wall of the aperture and tends to seal the first pressure environment from the second pressure environment and maintain the seal under a variety of mechanical loads. A chassis is secured within the barrier wall. The chassis has a pocket located such that when the plug is inserted into the barrier wall aperture a portion of the pocket aligns with the aperture. The plug is secured by attachment to the chassis.

26 Claims, 7 Drawing Sheets

APPARATUS FOR SEALING INSTRUMENTS IN A DOWNHOLE TOOL

BACKGROUND OF THE INVENTION

1. Field of the Invention

This invention relates generally to apparatus and methods for performing measurements in a borehole. More particularly, the invention relates to sealing measurement instruments in a housing inserted in a borehole.

2. Description of the Related Art

In well logging, performed after a borehole has been drilled, and in measurement-while-drilling ("MWD"), performed during drilling of a borehole, measurement instruments are housed in a hermetically sealed housing, typically a metal cylinder, inserted down the borehole. The housing maintains a relatively lower internal pressure environment than that external to the housing and protects the instruments against fluid invasion and damage due to mechanical impact and compression forces within the borehole. The instruments are typically secured in a housing and an access port in the housing is sealed by bolting a cover plate over the port. It is well known to improve the sealing action of such cover plates with a resilient gasket between the cover plate and the housing. Also, a plug and resilient o-ring may be substituted for the cover plate and gasket. Certain problems exist with the above described sealing arrangement. Twisting and bending of the housing and cover plate or plug are particularly severe in MWD applications because of the forces associated with the vertical loading, friction, bending, and rotation of the drill string and the housing connected to the drill string. Moreover, this twisting and bending is repeated with each rotation of the drill string. Also, for MWD applications the housing is subjected to the flow of drilling mud at high pressures.

Because of the above factors, seal failure is a problem for these borehole related applications. For example, o-ring failure is commonly caused by a phenomenon which may be described as "dynamic extrusion failure." In this type of failure, the o-ring seals a gap between a plug and a port in the housing in which the plug is held. The gap repeatedly changes as the changing forces, such as bending and pressure, act on the housing, plug, o-ring and port. With the fluid pressure acting on the o-ring, the o-ring is repeatedly extruded into the gap as the gap increases with each cycle and is then pinched as the gap decreases. Over a period of many cycles an o-ring subjected to these conditions tends to fatigue and fail.

SUMMARY OF THE INVENTION

An object of the invention is to provide an improved seal, such as for sealing instruments in a downhole tool.

Another object of the invention is to provide an improved housing for instruments in a downhole tool.

These and other objects are attained by a plug, having a desired cross section for insertion into a barrier wall aperture shaped to receive the plug. The barrier wall has a first pressure environment on its outside surface and a second environment on its inside surface. A bearing surface bears against the wall of the aperture. A flexing member, subject to and reactive to the first pressure environment, has an outer surface providing at least a portion of the bearing surface. The flexing member, in reacting to the first pressure environment, flexes at least a portion of the bearing surface to bear more tightly against the wall of the aperture and tends to seal the first pressure environment from the second pressure environment.

In accordance with another aspect of the invention, the barrier wall includes a drill collar. The drill collar has a port which provides the barrier wall aperture. A chassis having a desired cross section is inserted into the drill collar. The chassis also has a pathway for transmitting drilling mud through the drill string, and a pocket for housing an instrument. The pocket is located in the chassis such that when inserted into the drill collar at least a portion of the pocket aligns with the drill collar port. The plug has an interior end which inserts at least partly into the chassis pocket. The plug is secured in the drill collar at least partly by attachment of the plug to the chassis.

In a still further aspect of the invention the chassis has a locking member, and the plug has a second locking member on the plug interior end for engaging the first locking member and securing the plug within the drill collar. With the chassis in a first position within the drill collar the plug is received partly into the chassis. With the chassis secured in a second position within the drill collar the locking members engage.

Still other objects and advantages of the present invention will become apparent to those skilled in the art from the following detailed description.

DESCRIPTION OF THE PREFERRED EMBODIMENTS

Figure 1:
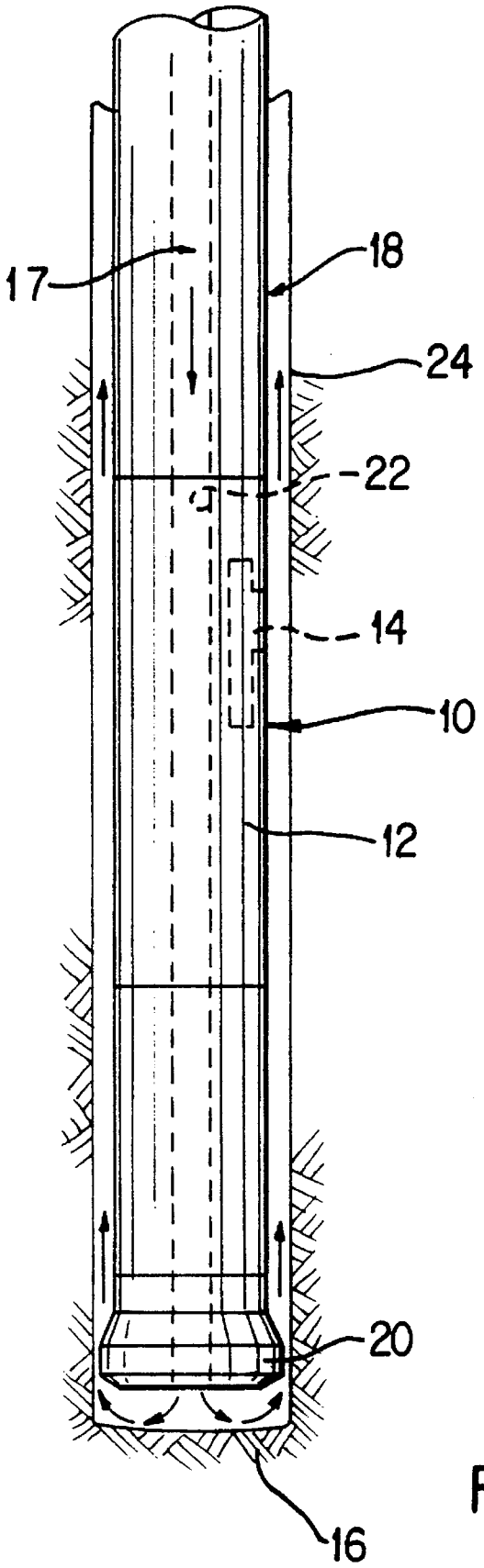
FIG. 1 is a diagrammatic view of the apparatus of the present invention attached to a drill string in a borehole.

Referring to FIG. 1, an MWD application of the present invention is shown. An MWD tool 10 comprises a housing 12 and at least one instrument accessible through an opening or port 14 in the housing 12. In this preferred embodiment the housing 12 is a cylindrical steel drill collar which comprises a subsection of the drill string 18. The drill string 18 and an attached drill bit 20 at its terminus are rotated by a drilling rig (not shown), creating a borehole 24 in the earth 16. Drilling mud 17 is injected at the surface into a bore 22 within the drill string 18, forcing the mud 17 out of the drill bit 20 and into the borehole 24. Consequently, some of the mud 17 is forced into the formation surrounding the borehole 24, while the remainder travels up the borehole 24 and is forced back to the surface. Due to friction and the weight of the mud, at the bottom of a deep borehole the drilling mud pressure within the borehole and external to the drill string may be very high. Pressures of 20,000 psi and higher are not uncommon. Since the MWD tool 10 is normally located in the drill string 18 relatively close to the drill bit 20, the housing 12 is subjected to nearly maximum mud pressure.

Figure 2:
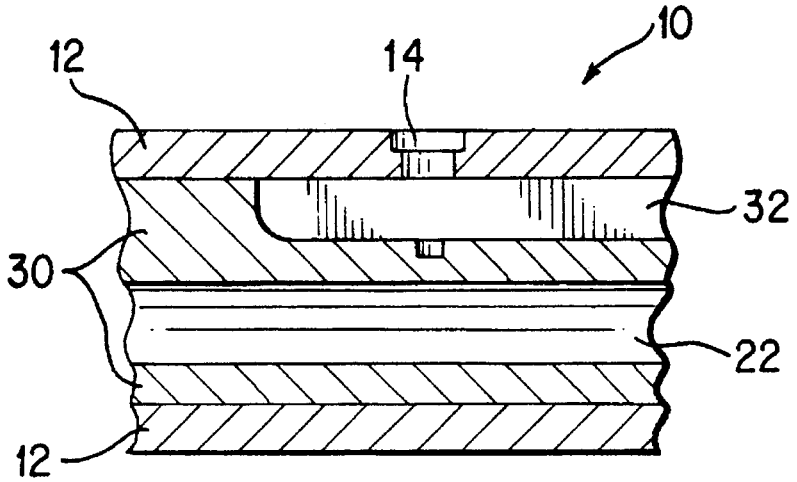
FIG. 2 is cross section view of a housing and chassis of the present invention.

Referring now to FIG. 2, a cross section of part of the MWD tool 10 is shown. The housing 12 comprises a drill collar into which a chassis 30 is removably fitted. The chassis 30 has a pocket 32 for an electronic instrument (not shown) and a bore 22 for the passage of drilling mud 17 (FIG. 1). The instrument in the chassis 30 may be, for example, a radiation sensor or source such as for a nuclear measuring application, an electromagnetic sensor or source such as for a resistivity measurement, a sensor or source for an acoustic measurement, or some other device. The drill collar 12 has a port 14 which is located such that when the chassis 30 is fitted into the collar 12, the port 14 is in alignment with at least a portion of the pocket 32 in the chassis 30.

Figure 3:
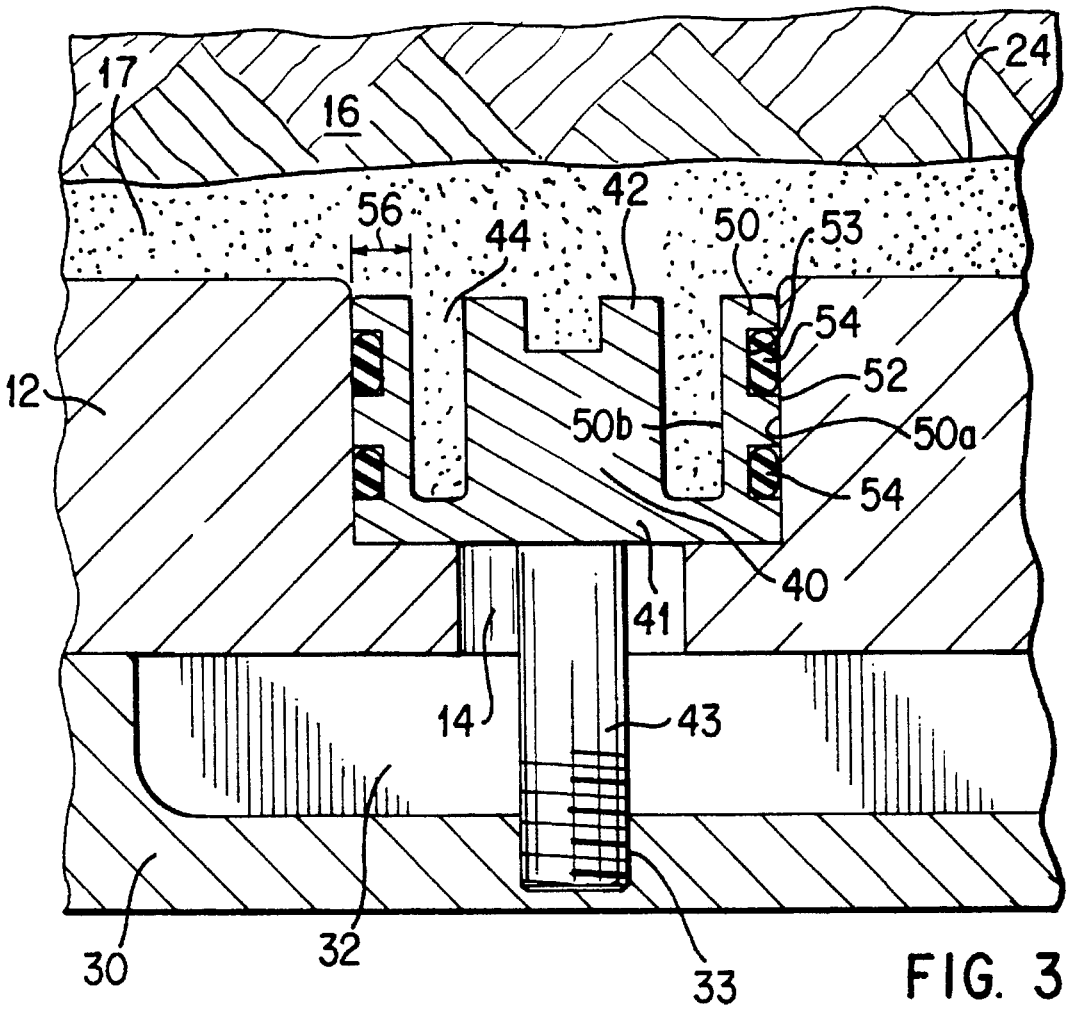
FIG. 3 is an enlarged portion of one wall of the housing and a portion of the chassis of FIG. 2, also showing a plug inserted into the housing.

As shown in FIG. 3, a plug 40 fits removably into the drill collar port 14 and partly into the chassis pocket 32. The plug 40 has an interior end section 41 and an exterior end section 42. The exterior end section 42 contains a cavity 44 in contact with the high pressure mud 17 in the borehole 24. Surrounding the cavity 44 is a peripheral segment 50 of the exterior end section 42 having a bearing surface **50*a* facing and bearing against the port wall 52 of the port 14 tending to seal the mud 17 from the chassis 30. The peripheral segment 50 acts as a flexing member that is subject to and reactive to the pressure of the mud 17, the mud 17 being communicated to the peripheral segment 50 through the cavity 44. That is, the peripheral segment 50 provides a bearing wall having a bearing surface 50*a* that bears against the port wall 52, and a fluid side 50*b* in communication with the mud 17. In reacting to the fluid pressure, the peripheral segment 50 forces the bearing surface 50*a* to bear more tightly against the port wall 52, tending to further seal the mud 17 out of the chassis 30. In the embodiment shown, the bearing surface 50*a* includes grooves 53 which are filled with a resilient sealing material 54, such as an o-ring, to further improve the ability of the bearing surface 50*a* to conform to the shape of the port wall 52**.

The peripheral segment 50 has a thickness 56, which is small enough so that when forces applied to the drill collar 12 deform the port 14 and plug 40, causing at least a portion of the port wall 52 to tend to move away from the bearing surface **50*a*, the mud 17 exerts a force on the peripheral segment 50, causing the bearing surface 50*a* to tend to conform to the deformed shape of the port 14 and move toward the port wall 52**.

In a preferred embodiment, the plug 40 comprises a material having relatively more elasticity than the material of the drill collar 12 so that under the effects of the fluid pressure on the collar 12 and the plug 40, the elasticity of the peripheral segment 50 further contributes to the bearing surface **50*a* tending to conform to the shape of the port wall 52. Also, the elasticity allows the required flexing of the peripheral segment 50 with a thickness 56 which is relatively greater than that required for the peripheral segment 50 if the material were not relatively more elastic than the material of the collar 12**.

Figure 4:
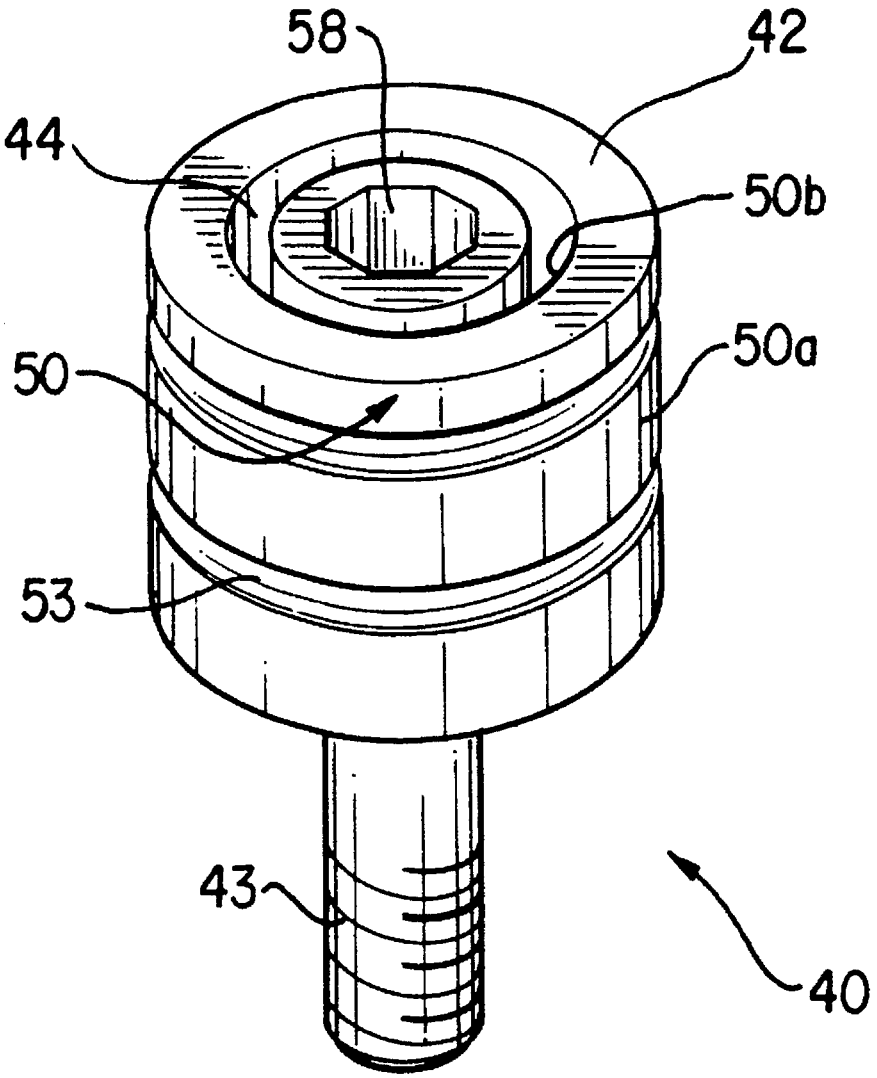
FIG. 4 is a perspective view of the plug of FIG. 3.

In the embodiment shown in FIGS. 3 and 4, the plug 40 is cylindrical in shape, with a circular top. Referring now to FIG. 4, the cylinder side is oriented essentially vertically and provides the bearing surface **50*a*. The exterior end section 42 includes a cavity 44 which may be described as a circular slot or channel. The channel has a bottom and a first and second side, the channel sides being essentially parallel to the bearing surface 50*a*. One of the channel sides forms the fluid side 50*b* of the peripheral segment 50**.

Figure 5:
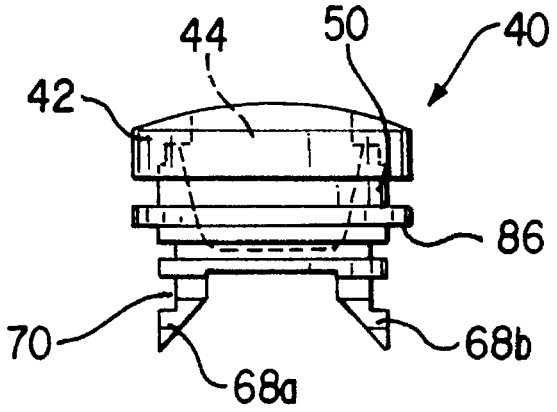
FIG. 5 is a side view of another embodiment of the plug of the present invention.
Figure 6:
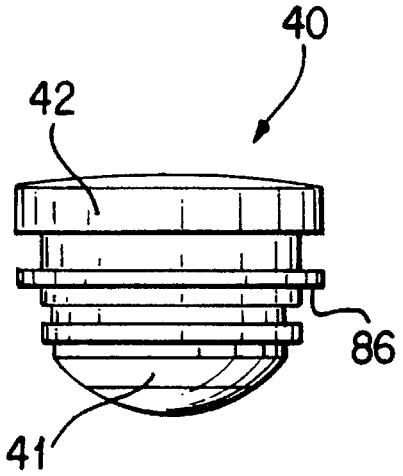
FIG. 6 is another side view of the embodiment of FIG. 5, with the plug rotated 90 degrees in relation to the view of FIG. 5.

In the alternative embodiment for the plug 40 shown in FIGS. 5 and 6, the cavity 44 in the exterior end section 42 includes a hollowed-out portion occupying the entire region surrounded by the peripheral segment 50. This cavity 44 acts to communicate fluid pressure to the peripheral segment 50 whether the cavity 44 is empty or filled with a flexible material, such as a high performance plastic or elastomer, reactive to fluid pressure. For various measurement applications, including nuclear, electromagnetic, acoustic, or others, with sources and/or detectors beneath the plug 40 it may be advantageous to fill the cavity 44 with plastic, elastomeric or other low density material having known transmission characteristics so that fluid or other material in the borehole 24 having unknown transmission characteristics is displaced from the cavity 44.

FIGS. 3 and 4 also show an arrangement for securing the plug 40, in which the plug 40 has a threaded stud 43 extending from its interior end section 41. The chassis 30 has a matching threaded bore 33 for receiving the stud 43. A hexagonal or square socket 58 is included in the center of the exterior end section 42 of the plug 40 for receiving a wrench used to rotate the plug 40 and screw the stud 43 into the bore 33.

Alternative arrangements for securing the plug 40 will be described; however, next an alternative configuration of the plug 40 is described. The plug 40 shown in FIGS. 5 and 6 is generally cylindrical and has a bifurcated interior end section 41 forming legs **68*a* and 68*b* extending downward. A circular groove 70 extends around the interior end section 41. The interior end section 41 in the plug as shown here is bifurcated so that an instrument (not shown) located in the pocket 32 may engage the plug 40 with the legs 68*a* and 68*b* straddling the instrument. For other applications the plug 40 interior end section 41 may not be bifurcated. The groove 70 is for accepting a locking member and is in a plane essentially parallel to the axis of the drill collar 12**.

Figure 7:
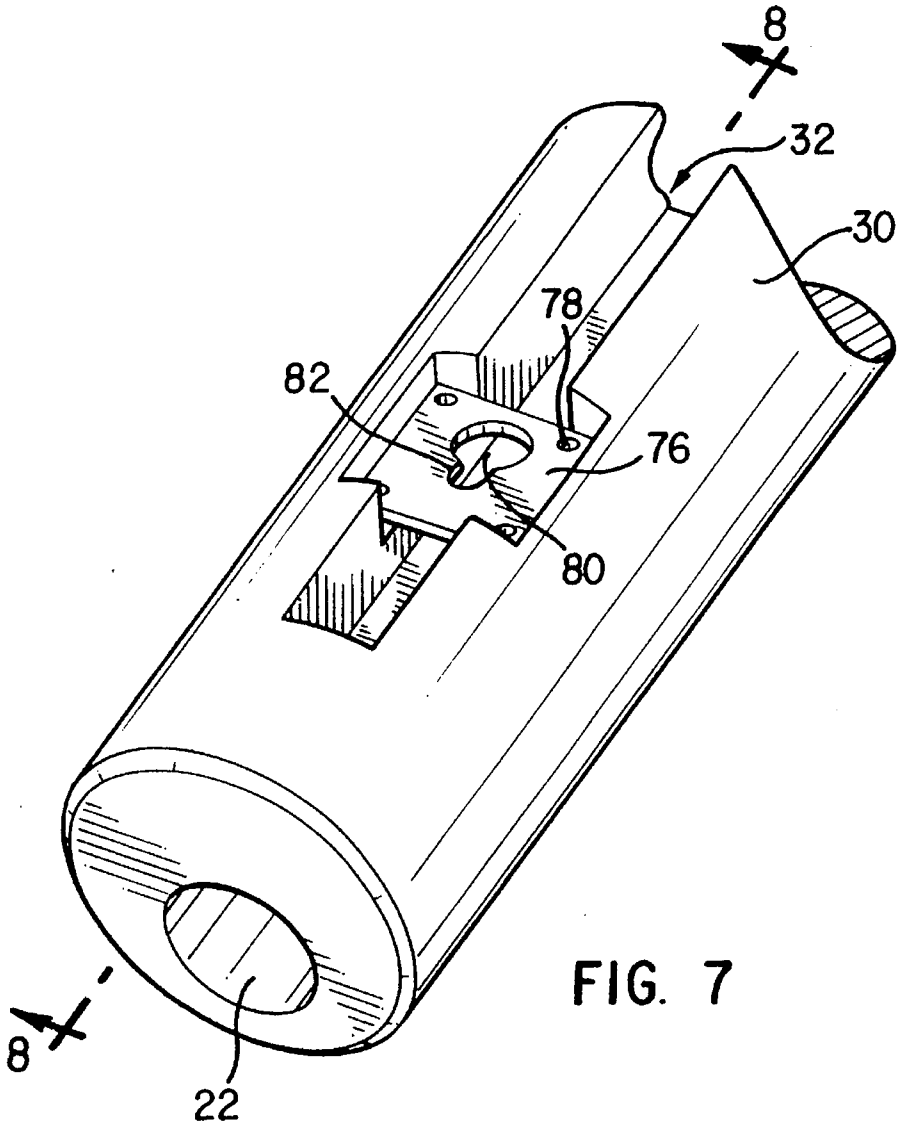
FIG. 7 is a perspective view of an embodiment of the chassis of the present invention.
Figure 9:
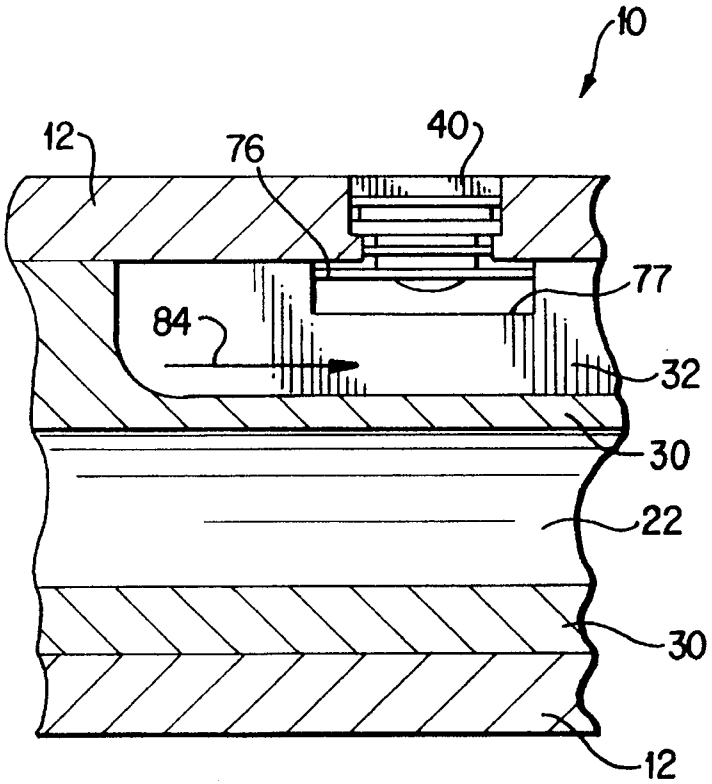
FIG. 9 is the same view of FIG. 8 with the chassis in a final position in the drill collar to lock the plug in the housing.
Figure 8:
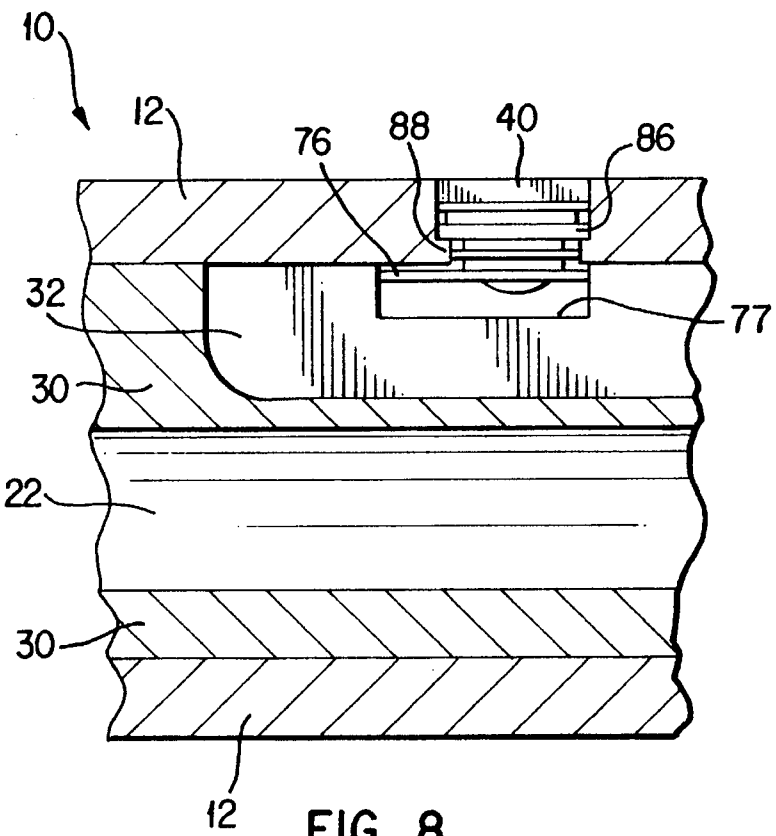
FIG. 8 is a section view of the chassis of FIG. 7 inserted in an initial position in a drill collar and having the plug of FIGS. 5 and 6 inserted into the drill collar and chassis.

FIGS. 7, 8 and 9 show one arrangement for securing the plug 40 of FIGS. 5 and 6 using the groove 70. In FIG. 7 chassis 30 is shown removed from the housing 12 (not shown). For this arrangement, a plate 76, attached to a flattened portion 77 (FIGS. 8 and 9) of the chassis 30 by recessed sockethead cap screws 78, provides a locking member. The plate 76 has an oval opening 80 large enough to receive the interior end section 41 of the plug 40 (not shown). An edge 82 of the opening 80 is thin enough to fit into the groove 70 of the plug 40 (not shown).

Referring now to FIGS. 8 and 9, for installation the chassis 30 is initially placed within the drill collar 12 in a first position (FIG. 8) in which the opening 80 (not shown) in the plate 76 accepts the plug 40. The chassis 30 is then moved in the direction indicated by reference arrow 84 into a second position (FIG. 9) within the collar 12 by sliding the chassis 30 along the axis of the drill collar 12. The chassis 30 is locked into the second position by tightening a threaded sleeve(not shown) securely connecting and sealing an inside end of the drill collar 12 with the end of the chassis 30. In operation the chassis 30 is further held in position by fluid pressure acting on the chassis seal (not shown). In this second position, the edge 82 of the opening 80 in the plate 76 fits into at least a portion of the groove 70 of the plug 40 thereby locking the plug 40 into position in the drill collar 12. The plug 40 has a lip 86 around its circumference and the collar 12 has a corresponding lip 88 around the circumference of the port 14 which engage when the plug 40 is fully inserted. The lip 88 thus provides a stop which prevents the plug 40 from being pushed into the chassis 30 beyond the stop due to the fluid pressure of the drilling mud 17.

Figure 10:
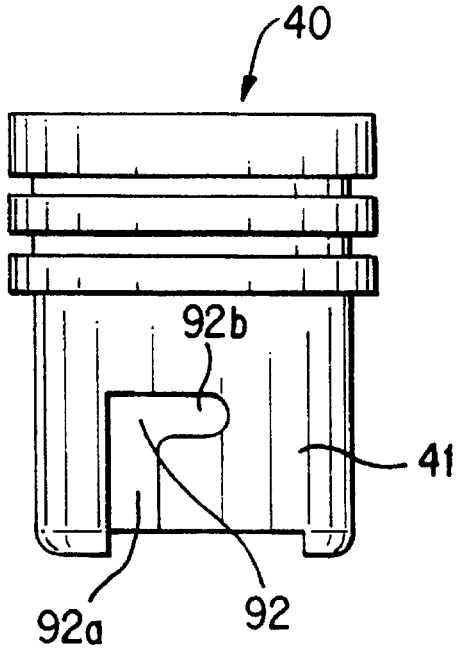
FIG. 10 is a side view of another plug illustrating an alternative locking arrangement.

FIG. 10 shows another configuration for the plug 40 in which the plug 40 is cylindrical and has one or more grooves 92 with a first portion 92*a* parallel to the axis of the plug 40 and extending toward the middle of the plug 40 through the interior end section 41. A second portion 92*b* of the groove 92 extends at an angle from the first portion 92*a*. The groove 92 thus forms an "L" shape. In the preferred embodiment of this locking arrangement, there are two such grooves 92 in the plug 40 located 180 degrees apart.

Figure 12:
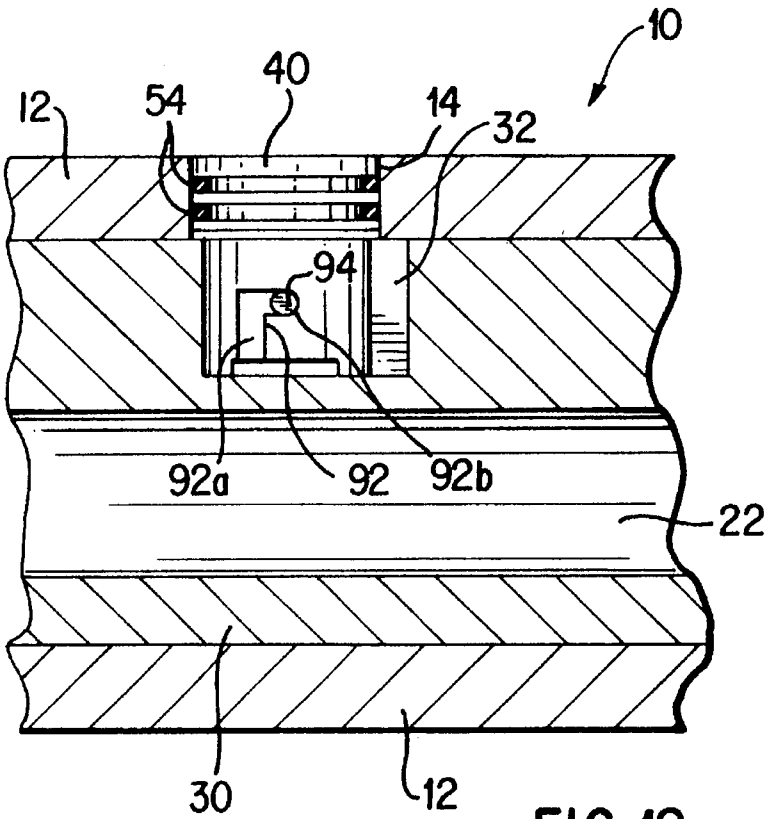
FIG. 12 is the same view of FIG. 11 with the chassis in a final position in the drill collar to lock the plug in the housing.
Figure 11:
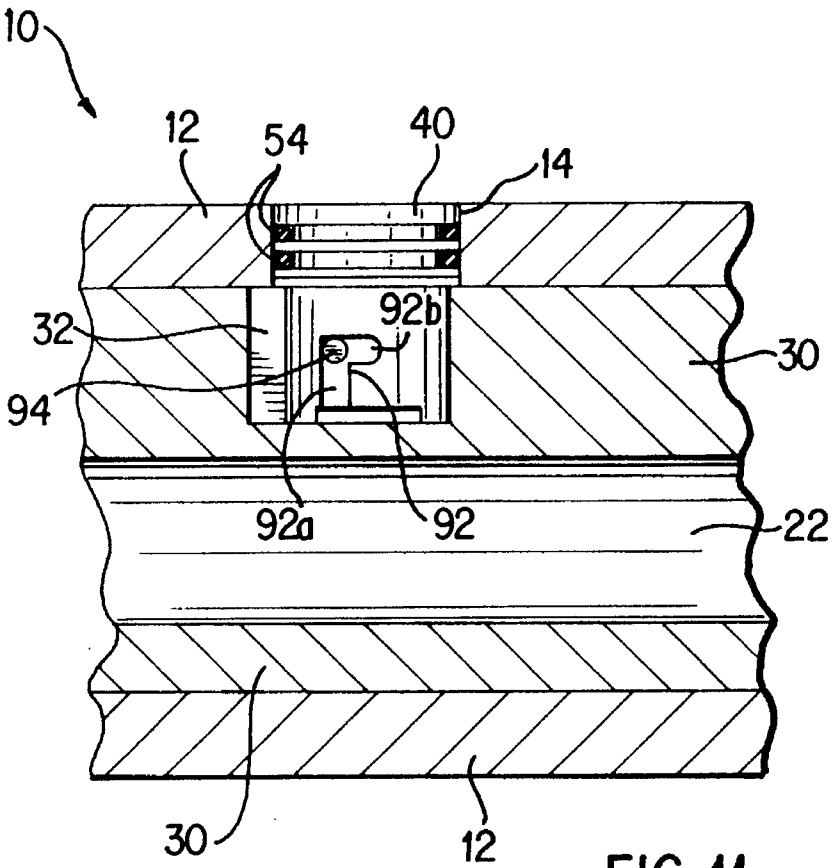
FIG. 11 is a section view of a chassis of the present invention inserted in an initial position in a drill collar and having the plug of FIG. 10 inserted into the drill collar and chassis.

Referring now to FIGS. 11 and 12, a locking arrangement is shown for the plug 40 of FIG. 10. Pins 94 in the chassis 30 match the grooves 92 in the plug 40 and are located such that a pin 94 fits in the first portion 92*a* of a groove 92 when the plug 40 is inserted in the collar 12 with the chassis 30 in a first position (FIG. 11). As shown in FIG. 12, when the chassis 30 is slid into a second position the pin 94 fits in the second portion 92*b* of the groove 92. With the chassis 30 secured in the second position, a pin 94 is held in the second portion 92*b* of the groove 92 thereby preventing the plug 40 from being removed from the port 14 in the drill collar 12.

The above description illustrates the preferred embodiments of the invention, but other embodiments are possible without departing from the scope of the invention. Accordingly, the drawings and description are to be regarded as illustrative, and not restrictive in nature.

What is claimed is:

1. An apparatus for sealing a first pressure environment on the outside surface of a barrier wall from a second, lower pressure environment on the inside surface of the barrier wall, the barrier wall having an aperture therein, the apparatus comprising:

a plug having a bearing surface that bears against the wall of the aperture; wherein the plug comprises a flexing member, subject to and reactive to the first pressure environment, a surface of the flexing member providing at least a portion of the bearing surface; and wherein the flexing member, in reacting to the first pressure environment, causes at least a portion of the bearing surface to bear more tightly against the wall of the aperture.

2. The apparatus of claim 1 wherein the flexing member comprises material selected to be more elastic than the material of the barrier wall.

3. The apparatus of claim 2 wherein the plug further comprises an exterior end and the flexing member comprises a peripheral segment surrounding a cavity therein.

4. The apparatus of claim 3 wherein the cavity comprises a slot approximating the cross section shape of the external end.

5. The apparatus of claim 3 wherein the cavity comprises a hollowed-out portion of the external end.

6. The apparatus of claim 5 wherein the cavity contains a flexible material reactive to the first pressure environment.

7. The apparatus of claim 3 wherein the bearing surface comprises a resilient sealing material.

8. The apparatus of claim 3 further comprising a chassis for insertion inside the barrier wall, the chassis having a pocket located therein such that when the chassis is inserted inside the barrier wall at least a portion of the pocket aligns with the aperture, and wherein the plug is secured at least partly by attachment of the plug to the chassis.

9. The apparatus of claim 8 wherein the chassis further comprises a first locking member, and the plug further comprises a second locking member for engaging the first locking member.

10. The apparatus of claim 9 wherein, with the chassis situated in a first position inside the barrier wall, the plug is received into the chassis, and, with the chassis situated in a second position inside the barrier wall, the first locking member engages the second locking member.

11. An apparatus for housing an instrument, the apparatus being subject to pressurized fluid on an external surface thereof and, comprising:

a housing having a walled port formed therein;

a plug for insertion into the walled port, the port being shaped to receive the plug, wherein the plug comprises;

a bearing surface that bears against the port wall; and a flexing member, subject to and reactive to the pressurized fluid, a surface of the flexing member providing at least a portion of the bearing surface, wherein the flexing member, in reacting to the pressurized fluid, flexes at least a portion of the bearing surface to bear more tightly against the wall of the port.

12. The apparatus of claim 11 further comprising a chassis for insertion into the housing, the chassis having a pocket located therein such that when the chassis is inserted into the housing at least a portion of the pocket aligns with the port, and wherein the plug is secured at least partly by attachment of the plug to the chassis.

13. The apparatus of claim 12 wherein the chassis further comprises a first locking member, and wherein the plug further comprises:

an interior end which inserts into the pocket; and a second locking member on the plug interior end for engaging the first locking member.

14. The apparatus of claim 13 wherein, with the chassis situated in a first position within the housing, the plug is received partly into the chassis, and, with the chassis situated in a second position within the housing, the first locking member engages the second locking member.

15. The apparatus of claim 14 wherein the second locking member comprises a groove extending around the plug interior end and the first locking member comprises an edge around the pocket for engaging the groove when the chassis is in the second position.

16. The apparatus of claim 14 wherein the second locking member comprises a groove on the plug interior end, the groove having a first portion extending substantially along the axis of the plug and another portion at an angle to the first portion, and wherein the first locking member comprises a pin for engaging the groove, wherein in the chassis first position the pin engages the first portion of the groove, and in the chassis second position the peg engages the second portion of the groove and locks the plug into the housing.

17. The apparatus of claim 13 wherein the second locking member comprises a threaded shaft, and the first locking member comprises a threaded bore for receiving the shaft so that threading the shaft into the bore locks the plug into the housing.

18. The apparatus of claim 12 wherein the bearing surface further comprises a resilient seal.

19. The apparatus of claim 12 wherein the plug comprises material selected to be more elastic than the material of the housing wall.

20. The apparatus of claim 12 wherein the flexing member comprises:

an external end of the plug having a cavity therein in contact with the pressurized fluid; and a peripheral segment of the external end, wherein the pressurized fluid communicates with the peripheral segment through the cavity.

21. The apparatus of claim 20 wherein the cavity comprises a slot in the external end approximating the shape of the cross section of the plug.

22. The apparatus of claim 20 wherein the cavity comprises a hollowed-out portion of the external end.

23. The apparatus of claim 22 wherein the cavity contains a flexible material reactive to the pressurized fluid.

24. An apparatus for housing an instrument within a borehole, and connecting the instrument to a drill string, comprising:

a drill collar having an outer wall that contacts pressurized fluid within the borehole, the drill collar having a walled port therein; and a plug inserted into the port, the plug having a bearing wall with a bearing side providing a bearing surface that bears against the port wall, and a fluid side in communication with the pressurized fluid, wherein the bearing surface includes a resilient sealing material in contact with the port wall, and wherein the pressurized fluid on the fluid side of the bearing wall tends to force the bearing wall toward the port wall.

25. The apparatus of claim 24 wherein the plug is cylindrical, the cylinder side providing the bearing side of the bearing wall, and wherein the circular top of the plug comprises a channel substantially concentric with the plug bearing side with one of the channel sides providing the bearing wall fluid side.

26. A method for sealing a first pressure environment on the outside surface of a barrier wall from a second, lower pressure environment on the inside surface of the barrier wall, the barrier wall having an aperture therein, the method comprising:

providing a plug which comprises a flexing member, a surface of the flexing member providing a bearing surface;

installing the plug in the aperture such that the flexing member is subject to and reactive to the first pressure environment, and in reacting to the first pressure environment causes the bearing surface to bear more tightly against the wall of the aperture.

* * * * *